US006383104B1

(12) United States Patent
Tan

(10) Patent No.: US 6,383,104 B1
(45) Date of Patent: May 7, 2002

(54) PARTS CARRIER WITH INTERGRAL ROLLERS

(75) Inventor: Louis B. H. Tan, Singapore (SG)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/501,614

(22) Filed: Feb. 10, 2000

(51) Int. Cl.[7] ..... B66C 17/08

(52) U.S. Cl. ..... 474/161; 414/154; 432/261; 432/241

(58) Field of Search ..... 474/161, 152, 474/190, 191; 414/154; 432/253, 261, 241; 280/47.34, 47.35, 79.3, 79.11

(56) References Cited

U.S. PATENT DOCUMENTS

| | | | | | |
|---|---|---|---|---|---|
| 379,390 | A | * | 3/1888 | Giles et al. | 414/154 |
| 687,508 | A | * | 11/1901 | Walker | 432/253 X |
| 710,643 | A | * | 10/1902 | Wilcox | 414/154 X |
| 1,739,176 | A | * | 12/1929 | Morris et al. | 432/253 X |
| 1,882,224 | A | * | 10/1932 | McQuigg | 414/154 |
| 1,999,356 | A | * | 4/1935 | Dressler et al. | 414/154 |
| 2,601,980 | A | | 7/1952 | Menough | 263/47 |
| 3,825,873 | A | | 7/1974 | Herron et al. | 339/8 R |
| 4,178,856 | A | * | 12/1979 | Dunville | 104/95 |
| 4,427,379 | A | * | 1/1984 | Duran et al. | 280/79.3 X |
| 4,650,064 | A | | 3/1987 | Slabaugh | 198/631 |
| 4,721,459 | A | * | 1/1988 | Fitz | 432/253 X |
| 4,958,843 | A | * | 9/1990 | Cole | 280/47.35 X |
| 5,005,848 | A | * | 4/1991 | Cornell | 280/79.11 |
| 5,042,423 | A | | 8/1991 | Wilkinson | 118/500 |
| 5,313,048 | A | * | 5/1994 | Berg et al. | 414/154 X |
| 5,591,278 | A | * | 1/1997 | Marcu | 152/152.1 |
| 5,776,391 | A | | 7/1998 | Sibley | 264/81 |
| 5,848,890 | A | | 12/1998 | McCormick | 432/261 |
| 6,033,612 | A | * | 3/2000 | Adams et al. | 264/258 |
| 6,106,422 | A | * | 8/2000 | Arai | 474/161 X |

* cited by examiner

*Primary Examiner*—Charles A Marmor
*Assistant Examiner*—Ha Ho
(74) *Attorney, Agent, or Firm*—David L. Narciso; McNees Wallace & Nurick LLC

(57) ABSTRACT

A device used to transfer and support articles during a high temperature heat treatment. The device is used to move articles into a heat treat furnace, hold the articles at an elevated temperature in a controlled atmosphere during the high temperature treatment and remove the articles from the furnace at the conclusion of the high temperature treatment, with no need to transfer the articles from the device. The device is comprised of a plurality of high temperature rollers, each roller including a roller bearing. A nonmetallic support surface capable of supporting the load of components undergoing the heat treatment is attached to the rollers. The device is designed to be nonreactive with either the furnace atmosphere or with the parts loaded onto it. The device also includes means to accommodate a temperature monitoring device such as a thermocouple to accurately monitor the temperature of the device during the thermal cycle.

22 Claims, 2 Drawing Sheets

PARTS CARRIER WITH INTERGRAL ROLLERS

BACKGROUND OF THE INVENTION

1. Field of the Invention

The present invention is directed to a novel system for transporting articles into and out of a furnace, and specifically to a novel non-reactive system for transporting and holding articles in a high temperature environment.

2. Description of the Prior Art

Various systems have been devised to move articles through furnaces. These systems usually have been directed to continuous furnace operations, that is, operations in which the furnace conditions are maintained, and articles that require elevated temperature processing are continuously moved through the furnace. Furthermore, the systems typically are directed to providing solutions to problems that peculiar to the processing methods.

One such system is set forth in U.S. Pat. No. 3,825,873 to Herron et al. This system sets forth a strand annealing method for thin walled metal tubes. The system utilizes copper or aluminum wheels with electrical contact material in the form of brushes to provide the required electrical connection at the high temperatures.

U.S. Pat. No. 5,848,890 to McCormick dated Dec. 15, 1998 is directed to an improved device for transporting items through a furnace. The device could be used as a pusher type transporting system or as a system to move articles through the furnace continuously. The device utilizes carriers that operate in channels that serve to protect the carriers from the furnace atmosphere. Insulating materials can be included in the channels to provide additional isolation from the furnace atmosphere. The carriers are made from ceramic, intermetallic material or graphite. The carriers are moved through the channels by any conventional means such as rollers or by pushing.

U.S. Pat. No. 5,042,423 to Wilkinson dated Aug. 27, 1991 is directed to a carrier for moving silicon wafers through a continuous CVD reactor. The carriers are graphite or are graphite-coated vessels that hold wafers and facilitate the coating of the wafers as they are moved through the reactor. The carriers are actually transported through the vessel on rails.

Activated Diffusion Healing (ADH) and brazing are processes used in the refurbishment of turbine engine components. While there are differences in the processes, both processes accomplish repairs of damaged portions of turbine engine hardware by applying repair material that has a lower melting temperature than the component base material. The damaged portions are removed and the removed material is replaced by repair material. The repair material is incorporated into the component base material by heating both the component and the repair material to a temperature above the melting temperature of the repair material, yet below the melting temperature of the component. The primary difference between brazing and ADH is in the materials used in repair and the temperature of repair. Brazing alloys typically are lower melting and retain this low melting characteristic even after incorporation into the component. Furthermore, braze repairs usually have mechanical properties that are different from the mechanical properties of the component base material. ADH is comprised of a plurality of alloys with different melting temperatures at least one of which has a high diffusion coefficient and is below the melting temperature of the components. As the ADH material is heated, it melts and is incorporated into the alloy. However, after an appropriate heat treatment, the low melting component diffuses into adjacent substrate, and the repaired area comprised of the ADH alloy has a melting temperature that is close to the melting temperature of the component. The repaired area also has mechanical properties that are very similar to the base material of the component. Details of brazing and the ADH process may be found in U.S. Pat. Nos. 4,830,934, 5,240,491 and 5,666,643, assigned to the assignee of the present invention, the contents of which are incorporated herein by reference.

Despite the differences between the two processes, both share common problems in processing the turbine components under repair in furnaces at high temperatures. A plurality of parts typically are loaded into the furnace on carriers or trays. The carriers are made from various materials, but typically include a metallic component which may have an overlying protective coating. Metallic components typically have infirmities for carrier applications at high temperature. First, only certain metals have melting temperatures that are sufficiently high to permit their use in these applications. At these elevated temperatures, components made from these metals typically experience a lowering of their yield strength. Additionally, there is a tendency for some of the materials used in the processes, particularly the ADH processes, to be transferred onto the metallic components. This material can degrade the mechanical performance of these components as it builds up on surfaces in which clearances must be maintained. In such applications, binding becomes a problem. For support surfaces, the processing materials tend to build up and are difficult to remove as they diffuse into the surfaces. For coated metal surfaces, the removal of residual ADH or braze materials frequently also results in the removal of the protective coating. As a result, the processing materials not only degrade the support surfaces, but can contaminate parts processed at a later time, again by diffusion.

While both intermetallics and ceramics have been combined with certain metal parts, these materials suffer from certain infirmities. Both tend to be brittle and can crack when impacted, such as if a large part shifts. While processing material readily can be removed from ceramics, intermetallics have the same degradation problem as do metallic materials.

Another solution has been to load parts into ceramic trays and insert them into a furnace or oven without the use of aids such as wheels. Such an apparatus can be used successfully when the parts are small and the resulting weights are light, but movement can be cumbersome and slow. Additionally, the ceramic trays are subject to fracture if there is a shifting of the parts.

What is needed is a device that can be used to facilitate the ingress and egress of a load of turbine engine parts into a high temperature furnace or oven to accomplish brazing or ADH. The device must be capable of supporting the parts at the elevated temperatures used to accomplish ADH and brazing and should not be adversely affected by materials utilized in the ADH or brazing process.

SUMMARY OF THE INVENTION

The present invention provides a transporting device for use in transferring parts and holding parts in high temperature environments above 1600° F. in controlled atmospheres. The transporting device is specifically designed for use in high temperature environments for rapid furnace ingress and egress of articles and to hold the articles during the heat treatment.

The device of the present invention is designed so as not to be reactive with either the furnace atmosphere or with the components loaded onto the transporting device. The device is comprised of a plurality of nonmetallic rollers that can withstand the high temperatures of the furnace without being adversely affected by the furnace atmosphere. Each roller has a central aperture for receiving a roller bearing, the roller bearing also being able to withstand high temperatures without being adversely affected by the furnace atmosphere. The roller bearing also has a central aperture. An attaching means extends through the roller and the roller bearing and attaches the roller containing the bearing to a nonmetallic support surface. The roller bearings are attached to the support surface by mounting means. The nonmetallic support surface is capable of supporting a load of turbine engine components as they undergo brazing or ADH at temperatures of at least about 1800° F. (982° C.) without yielding.

The device is designed to support a plurality of turbine engine components such as high pressure turbine nozzles. At least one high temperature spacing means is positioned between the support surface and each roller to prevent the roller from binding against the support surface. An optional high temperature spacing means is positioned between the attaching means and the roller. Each spacing means has a central aperture alignable with and corresponding to the central aperture of the roller and the central aperture of the bearing for receiving the attaching means. The transporting device also includes at least one non-metallic housing for receiving a temperature monitoring means. The at least one housing is positioned adjacent to the non-metallic support surface so that an accurate reading of the temperature of the parts located on the support surface can be obtained. The housing is designed so that a temperature monitoring means, such as a thermocouple, can readily be activated. The at least one housing includes at least one opening, and usually includes a plurality of openings to prevent the build-up of heat within the housing, facilitating free circulation of furnace atmosphere within the housing so that the temperature within the housing can provide an accurate representation of the temperature of the parts on the support surface.

An advantage of the present invention is that it can withstand the high temperatures and non-oxidizing environments in which ADH and brazing occurs, so that there is no deterioration of the transporting device. Further, because the material comprising the transporter is non-reactive with the materials used in the ADH and brazing processes, transporter contact with such ADH or brazing materials will not degrade the transporter. In fact, at the conclusion of a repair cycle, any ADH or brazing material can be readily removed from the transporter without the need for aggressive cleaning methods that abrade the surface, such as grinding.

Another advantage of the present invention is that the material utilized in the transporter is non-brittle and undergoes no decrease in mechanical strength at elevated temperatures. As a result, the transporter can be loaded at or near room temperature and placed in a furnace with little consideration of the effects of the load at elevated temperature on the transporter, as the transporter will not warp or distort.

Another advantage of the present invention is that the constituent parts of the transporter have low thermal expansion coefficient and high thermal shock resistance. Because of the low thermal expansion coefficient of its constituent parts, the transporter can be heated to elevated temperatures and moved at these elevated temperatures with significantly reduced likelihood that the constituent moving parts will bind and interfere with one another as a result of thermal expansion upon reaching elevated temperatures. Furthermore, the transporter can be readily moved into and out of a furnace with significantly reduced likelihood of damage resulting from rapid temperature changes.

Other features and advantages of the present invention will be apparent from the following more detailed description of the preferred embodiment, taken in conjunction with the accompanying drawings which illustrate, by way of example, the principles of the invention.

Whenever possible, the same reference numbers will be used throughout the figures to refer to the same parts.

DETAILED DESCRIPTION OF THE INVENTION

Conventional transporting devices used to move articles such as gas turbine components into and out of high temperature furnaces where they can be repaired by brazing processing or ADH processing have been found to be unsatisfactory. While the devices themselves are processing aids that permit rapid transfer of the components into and out of the furnaces, thereby decreasing processing time, the conditions that the devices are subjected to are harsh and the materials utilized to manufacture the devices have properties that are the result of compromises. For example, ceramic materials are strong, having no significant decrease in yield strength with increasing temperature, but have neither good impact resistance nor good wear or abrasion resistance, thus making them unsuitable for moving parts or for situations in which loads may shift and impact surfaces of the device. Metals that can withstand high temperatures undergo a decrease in yield strength which adversely affects their load carrying ability, can creep which can affect tightly toleranced parts and have a tendency to incorporate any metallic repair materials with which they come in contact during the high temperature thermal processing into their matrix through diffusion, which results in an undesirable build-up of material and an adverse effect on materials properties. These compromises contribute to the shortening of the life of the transporting devices, which are expensive.

Figure 1:
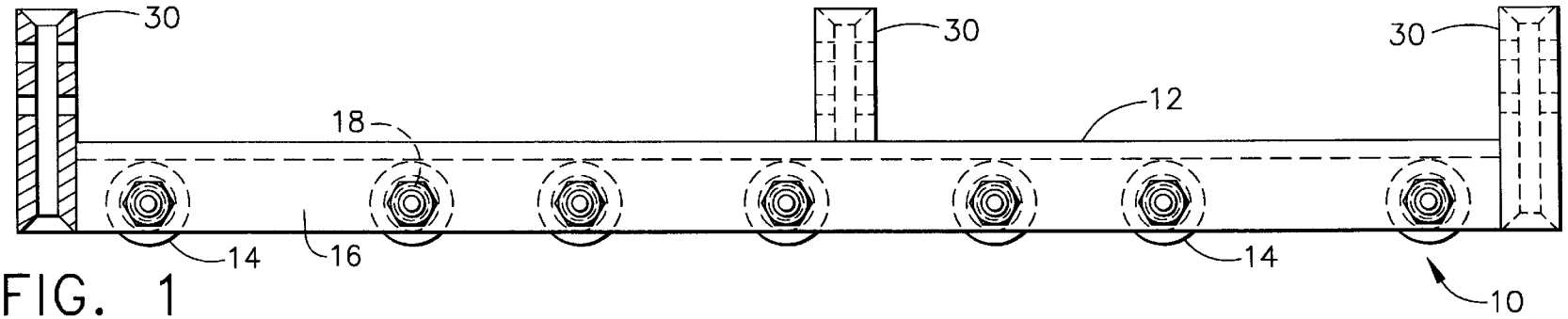
FIG. 1 depicts a side view of the transporting device of the present invention.

The present invention overcomes these shortcomings with a transporting device having a novel arrangement of components. This transporting device is used to convey turbine material components into and out of a furnace and to support the turbine components as they are processed using brazing processing repairs and/or ADH processing repairs at temperatures in the range of about 1800° F. (982° C.) to about 2350° F. (1288° C.). Referring now to FIG. 1, which is a side view of the transporting device 10 for use in high temperature environments of the present invention, there is provided a nonmetallic support surface 12 for supporting a furnace load. Nonmetallic support surface 12 is comprised of a material that does not undergo a significant decrease in yield strength as the temperature is increased and from which braze material or ADH material can be readily removed. While ceramic materials such as alumina (96% purity) may be used, these materials are very brittle and are difficult to manufacture to the size and thicknesses required. Another usable material for support surface 12 is a ceramic matrix composite in which reinforcing fibers are placed within a ceramic matrix. Both the selected matrix and selected reinforcing fibers must be capable of withstanding elevated temperature operations. A preferred material is one that has high thermal conductivity, good strength at high temperatures, good and good resistance to thermal shock and erosion. Graphite, when used in an inert atmosphere has these properties. It can be used in elevated temperature environments in inert atmospheres at temperatures up to 5000° F. Most preferably graphite conforming to grade 2191 is utilized.

Figure 2:
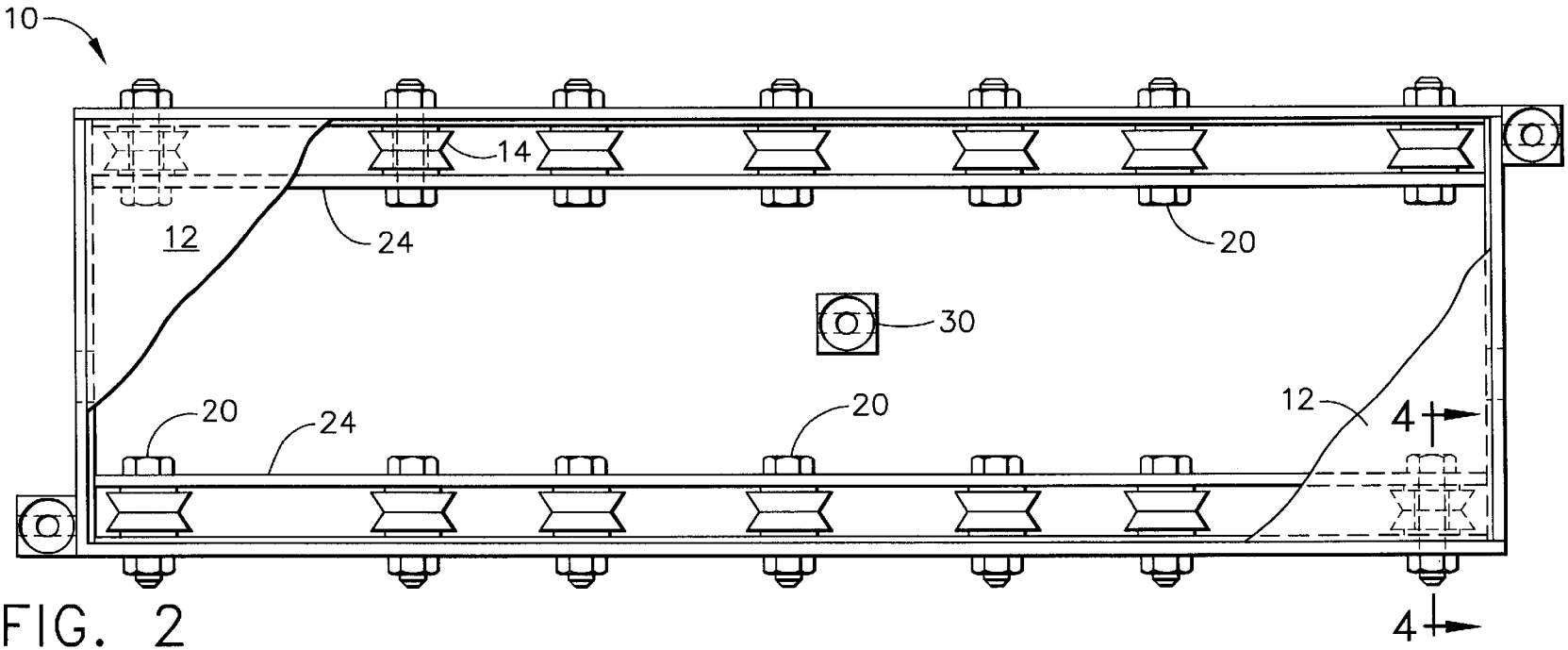
FIG. 2 depicts a top view of the transporting device of the present invention.
Figure 3:
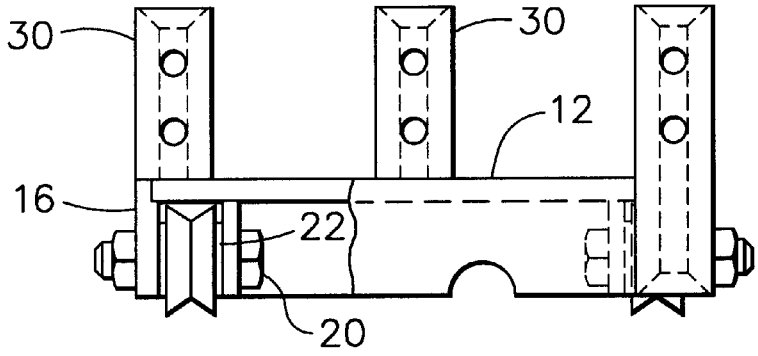
FIG. 3 depicts an end view of the transporting device of the present invention.

The support surface 12 is attached to a plurality of rollers 14. As shown in FIG. 2, which is a top view of the present invention, there are 14 rollers 14, although the number of rollers 14 may be varied to accommodate transporting devices of different sizes. The rollers 14 may be attached to support surface in any convenient manner. As shown in FIG. 1 and FIG. 3, which is an end view of the present invention, support surface 12 includes an attached vertical member 16 depicted as a rail or beam in FIG. 1 that has at least one surface substantially perpendicular to support surface 12. Vertical member 16 may be a separate part or may be manufactured integral with support surface 12. Rollers 14 are attached to vertical member 16 as will be explained. However, rollers can be attached to support surface by any conventional method. For example, the bottom of support surface 12 may include affixed brackets to which rollers 14 can be assembled, making vertical member 12 optional.

Unlike prior art rollers made from metal, rollers 14 are manufactured from graphite material, preferably graphite grade 2191 material. The advantage of graphite rollers is that, although expensive, they have excellent wear characteristics, so they have a long life, unlike most ceramic materials. And, unlike metal, they are not subject to a build up of either brazing materials or ADH materials, so that binding as a result of deposition of materials onto the roller surface is significantly reduced or eliminated. Any metals that are deposited onto these rollers can be removed easily by wiping. Also unlike metal rollers, graphite rollers 14 will support the load of turbine engine components transmitted through support surface 12, and will not yield under the loading of these components. Thus distortion of rollers 14, which can negatively impact mobility, is eliminated. A transporting device 10 such as depicted in FIG. 1–4 may be loaded with up to 10 high pressure turbine nozzles which each weigh about one pound apiece. Typically, however, only about 8 high pressure turbine nozzles are transported and processed on the device at any one time. Other turbine components, such as blades, can also be processed, but the total weight of such turbine components normally will not exceed the weight of a load of turbine nozzles.

Referring again to FIG. 1, each roller includes a central aperture. This central aperture is present to receive a bearing 18. The bearing material must be compatible with the roller, must be capable of withstanding high temperature exposure and should not be adversely affected by potential contact with ADH materials or braze materials. While several bearing materials may be used, including steel, a preferred bearing that can be inserted into roller 14 is comprised of molybdenum. A molybdenum bearing provides the advantage of having a thermal coefficient of expansion that can be matched to the graphite roller 14 without damaging the roller at furnace temperatures in the anticipated ranges of 1800–2350° F. Each roller bearing also has a central aperture.

The roller 14 and bearing 18 are held in place with a fastening device 20, which may be a screw as shown in FIG. 2 and 3. However, a nut and bolt combination may also be utilized, if desired. The nut may include a self-locking feature as is well known in the art. The fastening device is assembled through apertures in the vertical rails or through the optional brackets and through the central aperture of bearing 18 and either into or through member 16. The material utilized for fastening device 20 is not as critical as for the other parts previously discussed, as any material that will permit the fastening device 20 to accomplish its fastening function at the elevated furnace temperatures may be utilized. Thus steel or superalloys could be used, although molybdenum fasteners are preferred.

Figure 4:
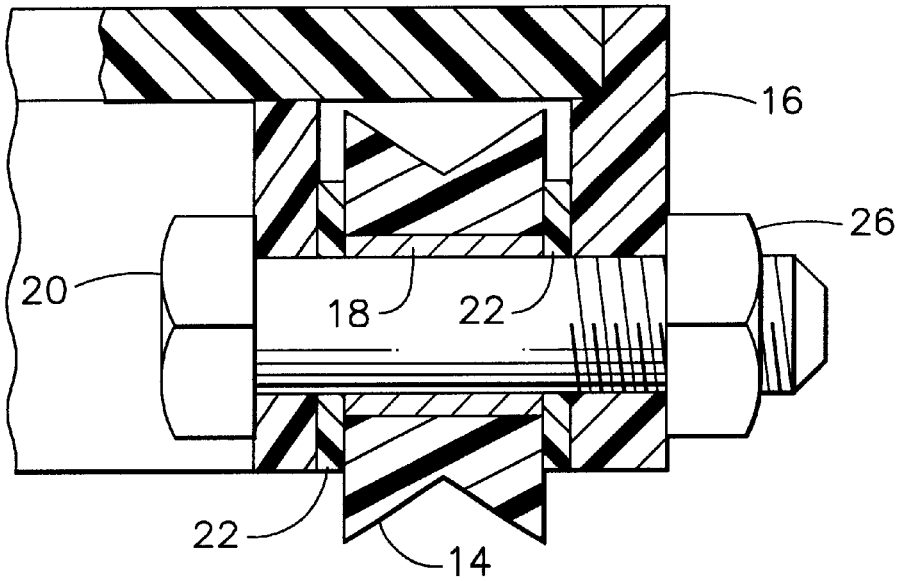
FIG. 4 depicts an optional embodiment of attaching rollers to the transporting device.

Roller 14 is spaced from the head of fastening device 20 on one end and from vertical member 16 having a series of apertures on the other end. This is to prevent binding of the roller by contact with either part. Referring to FIG. 3, the spacing function is provided between roller 14 and member 16 by a spacer 22, preferably made from molybdenum. Spacing is provided between the head of fastening device 20 and roller 14 by a second vertical member 24 having a series of apertures corresponding to the series of apertures on the first vertical member, the second vertical member also depicted as a rail or a beam in FIG. 2, extending downward from support surface 12 and extending substantially the entire length of support surface 12. Second support member 24 can be manufactured to be integral with support surface 12 or can be a removable member. It preferably is manufactured from graphite. Alternatively, a plurality of brackets (not shown) attached to a corresponding number of rollers attached to the underside of support surface 12 can replace vertical members 16, 24. The brackets represent an alternative means of attachment of the bearings to support surface 12. Like the vertical members, the brackets may be made separately from graphite or molybdenum and affixed to surface 12 or can be manufactured integral with support surface 12. FIG. 4 is an optional embodiment of the attaching rollers in which a spacer 22, preferably molybdenum, is inserted between roller 14 and head of fastening device 20, which is shown as a bolt. The bolt has a body with at least an end opposite the head being threaded, the body extending through an opening in vertical member 16, apertures in each of spacers 22, roller 14, bearing 18 and second vertical member 24. The bolt is threaded at the end opposite the head with a corresponding nut 26.

The transporting device 10 also includes at least one housing to house a temperature monitoring device. A plurality of devices is typically included. As shown in FIG. 1, 2 and 3, there are three housings 30. Housings 30 are designed so that temperature monitoring devices such as thermocouples can be readily inserted into them as required. Preferably the housings 30 are manufactured integral with the support surface 12, in which case they are preferably constructed of graphite. Optionally, the thermocouples can be semi-permanently mounted in the housings, that is, fixed within the housings but replaceable. These thermocouples can then be attached to leads that are in turn attached to the appropriate controls for temperature monitoring. Each housing includes a number of passages to permit circulation of atmosphere through the housings in order to obtain an accurate temperature profile of turbine components on the support surface 12.

In operation, turbine parts requiring repair and to which ADH repair material or braze repair material has been applied are loaded onto the transporting device. The device is rolled into the furnace and a non-oxidizing atmosphere is provided in the furnace. All furnaces used for such repairs include the capability of providing such an atmosphere. These include inert atmospheres and slightly reducing atmospheres in which hydrogen is mixed with argon or helium. Typically such atmospheres are applied to accomplish repairs of turbine components. However, when the transporting devices of the preferred embodiments of the present invention are utilized, such an atmosphere is required as the graphite material is readily oxidizable at the temperatures required to accomplish the repair. After the repair has been accomplished, the parts are allowed to cool in the furnace under atmosphere to a temperature sufficiently low so that oxidation of the graphite components of the transporting device will not occur. The transporting device can then be removed from the furnace. Such steps are not required if the transporting device is made of a non-oxidizable material such as alumina or a ceramic matrix composite that contains no graphite.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A transporting device for use in non-oxidizing, high temperature environments to transport and hold articles, the device comprised of:

a plurality of graphite rollers, each roller having a central aperture;

a graphite support surface mounted to the rollers to support the articles;

a first graphite vertical rail attached to the support surface and having at least one surface substantially perpendicular to the support surface, the rail having a plurality of apertures;

a second vertical graphite rail spaced from the first rail and attached to the support surface, the second rail having at least one surface substantially perpendicular to the support surface and a plurality of apertures corresponding to the apertures of the first rail;

a molybdenum bearing positioned within the aperture of each roller, each bearing having a central aperture;

a plurality of graphite spacers, a first graphite spacer positioned between each roller and the first vertical rail and a second graphite spacer positioned between each roller and the second vertical rail to space each roller from the rails, each spacer having a central aperture concentric with the central aperture of each roller and the central aperture of each bearing;

high temperature bolts having heads and threaded bodies for attaching each roller, each bearing and the spacers to the rails, the body of each bolt extending through one aperture on the second rail, the central aperture of the second spacer, the central aperture of the roller, the central aperture of the bearing, the central aperture of the first spacer and through the corresponding aperture of the first rail, each bolt body secured at an end opposite the head by a nut; and at least one graphite housing for receiving a thermocouple integral with the non-metallic support surface, the housing having a plurality of openings.

2. A transporting device for use in high temperature environments above 1600° F. to transport and hold articles, the device comprised of:

a plurality of nonmetallic rollers, each roller having a central aperture;

a nonmetallic support surface mounted to the rollers to support the articles;

means for mounting the rollers to the support surface;

a plurality of high temperature bearings having central apertures, one bearing positioned within the aperture of each roller at least one high temperature spacer positioned between the mounting means and each roller to space each roller from the mounting means, each spacer having a central aperture concentric with the central aperture of each roller and the central aperture of each bearing;

a plurality of high temperature means for attaching each roller, each bearing and each spacer to the mounting means, each attaching means extending through the central aperture of each roller, the central aperture of each bearing, the central aperture of each spacer and into the mounting means; and at least one non-metallic housing for receiving a means for monitoring temperature positioned adjacent to the non-metallic support surface, the housing having a plurality of openings.

3. The transporting device of claim 2 wherein the means for mounting the rollers to the support surface includes at least one bracket assembly positioned on an underside of the support surface.

4. The transporting device of claim 3 wherein the at least one bracket assembly is manufactured integral with the support surface.

5. The transporting device of claim 3 wherein the at least one bracket assembly is separately manufactured and affixed to the support surface.

6. The transporting device of claim 5 wherein the bracket assembly is manufactured of molybdenum.

7. The transporting device of claim 2 wherein the means for mounting the rollers to the support surface is comprised of a first vertical member extending from the support surface, the vertical member having at least one surface substantially perpendicular to the support surface.

8. The transporting device of claim 7 wherein the first vertical member extending from the support surface is integrally manufactured as a feature of the support surface.

9. The transporting device of claim 7 wherein the first vertical member extending from the support surface is a beam attached to the support surface.

10. The transporting device of claim 7 wherein the means for mounting the rollers to the support surface further includes a second vertical member extending from the support surface, the vertical member having at least one surface substantially perpendicular to the support surface.

11. The transporting device of claim 10 wherein the second vertical member extending from the support surface is integrally manufactured as a feature of the support surface.

12. The transporting device of claim 10 wherein the second vertical member extending from the support surface is a beam attached to the support surface.

13. The transporting device of claim 2 including three non-metallic housings for receiving the means for monitoring temperature.

14. The transporting device of claim 2 wherein the non-metallic support surface is comprised of graphite.

15. The transporting device of claim 14 wherein the at least one non-metallic housing is integral with the support surface.

16. The transporting device of claim 2 wherein the non-metallic support surface is comprised of a non-oxidizable material.

17. The transporting device of claim 16 wherein the non-metallic support surface is comprised of a material selected from the group consisting of alumina and a ceramic matrix composite.

18. The transporting device of claim 3 wherein the high temperature means for attaching each roller, each bearing and each spacer to the support surface are bolts, each bolt having a head and a threaded body extending through the central aperture of each roller, the central aperture of each bearing, the central aperture of each spacer and the at least one bracket assembly, and threaded into place at an end opposite the head by a nut.

19. The transporting device of claim 3 wherein the high temperature means for attaching each roller, each bearing and each spacer to the support surface are screws, each screw extending through the central aperture of each roller, the central aperture of each bearing and the central aperture of each spacer and threaded into the bracket assembly.

20. The transporting device of claim 2 wherein the rollers are comprised of graphite.

21. The transporting device of claim 20 wherein each high temperature bearing positioned within the central aperture of each roller is comprised of a material that has a thermal expansion that is compatible with a thermal expansion of the graphite roller at temperatures in the range of 1800–2350° F.

22. The transporting device of claim 20 wherein a spacing means is positioned on either side of each roller to space the roller from the mounting means and is comprised of molybdenum.

* * * * *